US010119236B2

(12) United States Patent
Sim et al.

(10) Patent No.: US 10,119,236 B2
(45) Date of Patent: Nov. 6, 2018

(54) COMPACTION GROUTING SYSTEM CONSTRUCTION METHOD CAPABLE OF SEISMIC REINFORCEMENT AND QUALITY CONTROL

(71) Applicants: Doo Sub Sim, Chungcheongnam-do (KR); Ji Hyun Park, Chungcheongnam-do (KR)

(72) Inventors: Doo Sub Sim, Chungcheongnam-do (KR); Ji Hyun Park, Chungcheongnam-do (KR)

(73) Assignees: XENON GROUND TECHNOLOGY CORP., Chungcheongnam-do (KR); DENVER KOREA E&C CO., LTD., Gyeonggi-do (KR)

( * ) Notice: Subject to any disclaimer, the term of this patent is extended or adjusted under 35 U.S.C. 154(b) by 0 days.

(21) Appl. No.: 15/328,980

(22) PCT Filed: Aug. 4, 2015

(86) PCT No.: PCT/KR2015/008137
§ 371 (c)(1),
(2) Date: Jan. 25, 2017

(87) PCT Pub. No.: WO2016/021911
PCT Pub. Date: Feb. 11, 2016

(65) Prior Publication Data

US 2017/0226712 A1 Aug. 10, 2017

(30) Foreign Application Priority Data

Aug. 5, 2014 (KR) ..... 10-2014-0100396

(51) Int. Cl.
*E02D 3/12* (2006.01)

(52) U.S. Cl.
CPC ..... *E02D 3/12* (2013.01); *E02D 2250/003* (2013.01); *E02D 2300/0021* (2013.01)

(58) Field of Classification Search
CPC ..... E02D 3/12; E02D 2250/003
See application file for complete search history.

(56) References Cited

U.S. PATENT DOCUMENTS 4,514,112 A * 4/1985 Sano ..... E02D 3/12 405/266
5,197,828 A 3/1993 Nakanishi et al.
(Continued)

FOREIGN PATENT DOCUMENTS

JP 2010156172 A 7/2010
KR 100209247 B1 7/1999
(Continued)

OTHER PUBLICATIONS

Int'l Search Report dated Nov. 19, 2015 in Int'l Application No. PCT/KR2015/008137.
(Continued)

*Primary Examiner* — Carib A Oquendo
(74) *Attorney, Agent, or Firm* — Panitch Schwarze Belisario & Nadel LLP

(57) ABSTRACT

A compaction grouting system ("C.G.S") construction method capable of seismic retrofit and quality control is provided. An injection pipe is inserted in the ground to an insertion depth and is provided for injecting a grout into the ground at the insertion depth. The grout is injected in predetermined quantities per unit time under an injection pressure that is a predetermined static pressure. A discharge pressure of the grout being injected is measured. At least one or more, among the injection pressure at which the grout is being injected and the unit time per which predetermined quantities of the grout are injected, is adjusted, according to the change in the measurement value of the discharge
(Continued)

pressure. The insertion depth at which the injection pipe is inserted in the ground is changed after the injection of the grout is completed.

3 Claims, 5 Drawing Sheets

(56) References Cited

U.S. PATENT DOCUMENTS

| | | | | |
|---|---|---|---|---|
| 5,234,289 | A | 8/1993 | Nakanishi et al. | |
| 6,801,814 | B1 | 10/2004 | Wilson et al. | |
| 2004/0165959 | A1 | 8/2004 | Shimada | |
| 2007/0014640 | A1* | 1/2007 | Kauschinger | E02D 3/12 405/266 |
| 2009/0304457 | A1 | 12/2009 | Shimada et al. | |
| 2010/0135731 | A1 | 6/2010 | Barron et al. | |

FOREIGN PATENT DOCUMENTS

| | | | |
|---|---|---|---|
| KR | 100399532 | B1 | 9/2003 |
| KR | 100737833 | B1 | 7/2007 |
| KR | 100907923 | B1 | 7/2009 |
| KR | 101282184 | B1 | 7/2013 |
| KR | 20140014552 | A | 2/2014 |

OTHER PUBLICATIONS

Office Action dated Jun. 16, 2017 in U.S. Appl. No. 15/329,056 by Sim.

* cited by examiner

COMPACTION GROUTING SYSTEM CONSTRUCTION METHOD CAPABLE OF SEISMIC REINFORCEMENT AND QUALITY CONTROL

CROSS-REFERENCE TO RELATED APPLICATION

This application is a Section 371 of International Application No. PCT/KR2015/008137, filed Aug. 4, 2015, which was published in the Korean language on Feb. 11, 2016, under International Publication No. WO 2016/021911 A1, and the disclosure of which is incorporated herein by reference.

TECHNICAL FIELD

The present invention relates to a compaction grouting system (C.G.S) construction method capable of performing a seismic reinforcement and a quality control, and more particularly, to a C.G.S construction method capable of performing a seismic reinforcement and a quality control that can form a grout pillar of a uniform form in the interior of a ground of an environment in which it is difficult to insert a pile into the ground.

BACKGROUND ART

Generally, a construction method for inserting an iron pile or the like into the interior of the ground is used as a method for reinforcing a soft ground.

However, in some cases, it is not possible to use such a construction method depending on the condition of the ground or the situation of the construction site.

In such cases, it is possible to apply a ground improvement method for reinforcing the ground using a method for injecting a non-flowable mortar-type injection material into the ground and forming a pillar-shaped consolidated body to compress and reinforce the surrounding ground, and such a construction method is well known as a compaction grouting system (C.G.S) construction method.

Because such a C.G.S construction method uses a low flowable material having a slump value of 5 cm or less, the consolidated body can be formed, while the injection material relatively less leaves the planned location, and it is possible to perform a work even in a narrow location such as a periphery of an existing structure work or a basement.

In addition, it is also possible to perform the construction with non-vibration/non-noise and to apply in urban or dense housing areas, and the used injection material also has environment-friendly characteristics.

However, since the injection state of the injection material to be injected into the ground is not checked with naked eye when performing the C.G.S construction method, there are problems of difficulty in understanding of the injection current situation and providing measures of the ground condition.

Thus, even when a ground crushing phenomenon caused by the injection of the injection material occurs, its provision is difficult, and there is a problem of taking the post actions after the crushing phenomenon occurs.

In addition, because checking of the designed quantitative injection and the construction quality control are dependent on the operator's experience value, there is a problem of difficulty in solving the question of the construction completion.

DISCLOSURE

Technical Problem

An aspect of the present invention is to solve the problems described in the background, and provides a C.G.S construction method capable of performing a seismic reinforcement and a quality control that can form a grout pillar of a uniform form in the interior of a ground of an environment in which it is difficult to insert a pile into the ground.

The technical problems to be solved by the present invention is not limited to the aforementioned technical problems, and other technical problems that have not been mentioned will be able to be clearly understood to a person who has conventional knowledge in the technical field to which the present invention pertains from the following description.

Technical Solution

According to an aspect of the present invention, there is provided a C.G.S construction method capable of performing a seismic retrofit and a quality control, the method including: an injection pipe inserting step for inserting an injection pipe, which is provided to inject a grout into a ground, to the ground; an injecting step for injecting the grout into the ground through the injection pipe inserted in the injection pipe inserting step, the grout being injected in predetermined quantities per unit time under an injection pressure that is a predetermined static pressure; a pressure measuring step for measuring discharge pressure which is a discharge pressure of the grout injected in the injecting step; an injection adjusting step for adjusting, depending on a change in measurement value of the discharge pressure measured in the pressure measuring step, at least one or more among the injection pressure of the grout in the injecting step, and the unit time at which predetermined quantities of the grout are injected; and a depth changing step for changing a depth at which the injection pipe is inserted in the ground after the injection of the grout is completed.

Here, the injection adjusting step may adjust the grout injection pressure of the injecting step lower than the predetermined static pressure, when the value of the amount of change in the discharge pressure for each depth measured in the pressure measuring step increases.

Further, the injection adjusting step may increase the unit time at which the predetermined quantity of grout of the injecting step is injected, when the value of the amount of change in the discharge pressure for each depth measured in the pressure measuring step decreases.

Meanwhile, the injecting step may inject the grout by settings that are adjusted in the injection adjusting step, when performing the injecting step again after the depth changing step.

Further, the injecting step may be set so that the injection amount per unit time set when injecting the grout is equal to or less than 50 times the ground permeability of the ground to which the grout is injected.

Advantageous Effects

According to an aspect of the present invention, it is possible to form a grout pillar of a uniform form in the interior of a ground of an environment in which it is difficult to insert the pile into the ground.

Such an effect of the present invention is not limited to the aforementioned mentioned effect, and other effects that are not mentioned will be clearly understood to those skilled in the art from the scope of the claims.

BEST MODE

Figure 1:
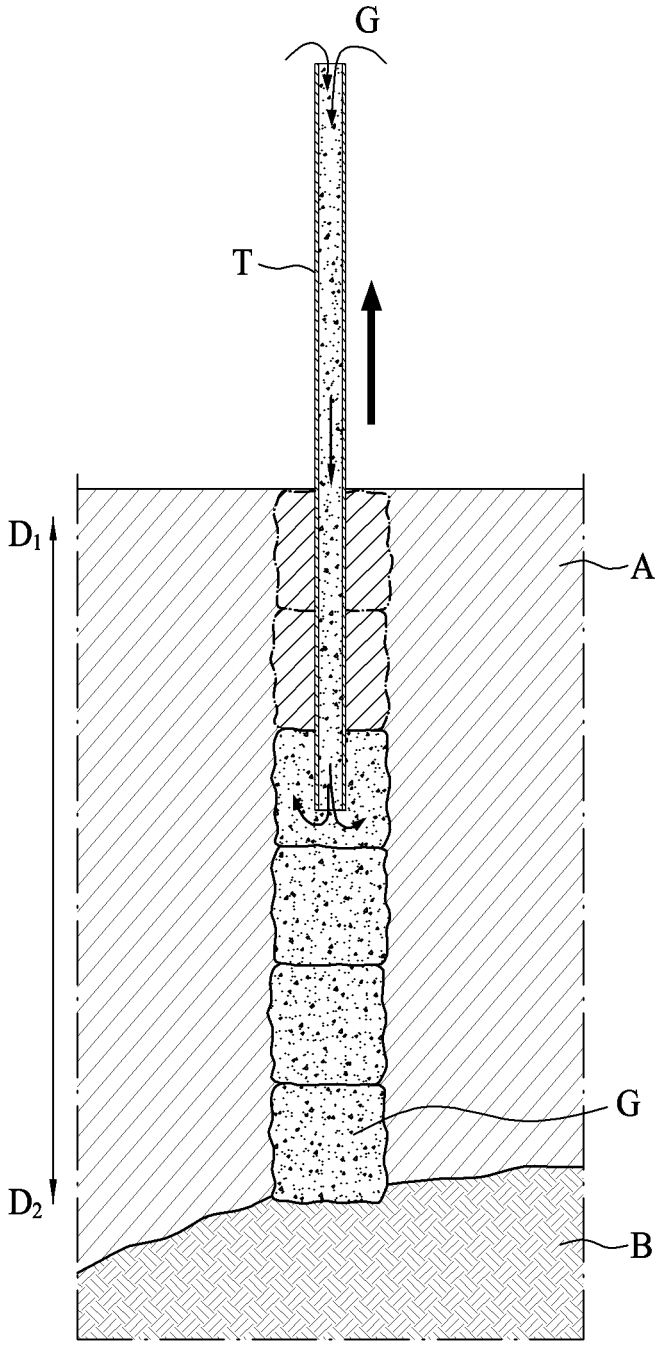
FIG. 1 is a diagram illustrating a state of forming a grout pillar inside a ground with uniform quality of soil using a C.G.S construction method.

Hereinafter, embodiments of the invention will be described in detail with reference to the accompanying drawings. The drawings are attached hereto to help explain exemplary embodiments of the invention, and the present invention is not limited to the drawings and embodiments. In the drawings, some elements may be exaggerated, reduced in size, or omitted for clarity or conciseness.

Hereinafter, an embodiment of the present invention will be described in detail with reference to the accompanying drawings. However, in describing the present invention, the description of functionalities or configurations that have been already known will be omitted for clarity of the subject matter of the present invention.

In addition, in describing the present invention, because the terms indicating the directions such as front/back or top/bottom are described so that those skilled in the art can clearly understand the present invention and indicate the relative directions, the scope of right is not limited thereby.

First, referring to FIGS. 1 through 4, the principle of the C.G.S construction method capable of performing the seismic reinforcement and the quality control according to the present invention will be described in detail.

Figure 2:
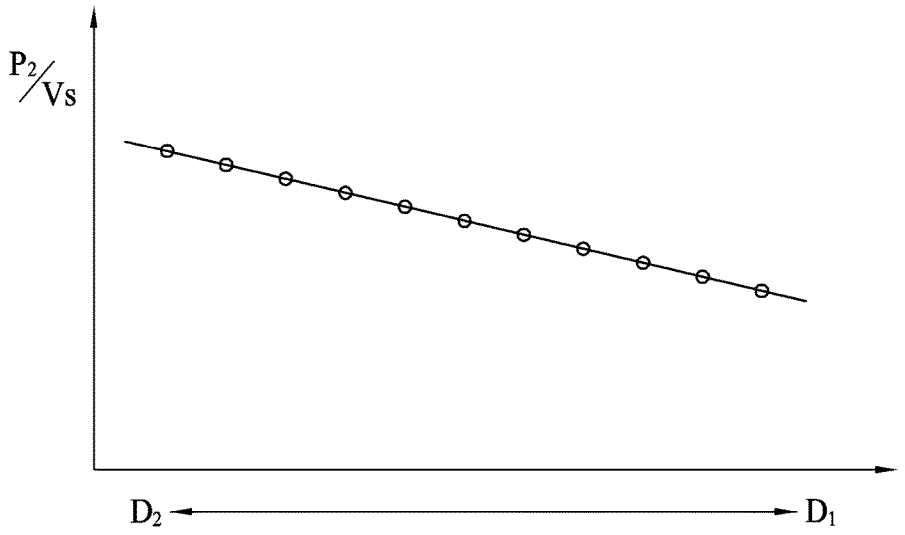
FIG. 2 is a graph illustrating a ratio of a grout discharge pressure per each depth and an injection amount per unit time of the grout expressed in the case of FIG. 1.

Here, FIG. 1 is a diagram illustrating a state of forming a grout pillar inside a ground with uniform quality of soil using the C.G.S construction method. FIG. 2 is a graph illustrating a ratio of a grout discharge pressure per each depth and an injection amount per unit time of the grout expressed in the case of FIG. 1.

Figure 3:
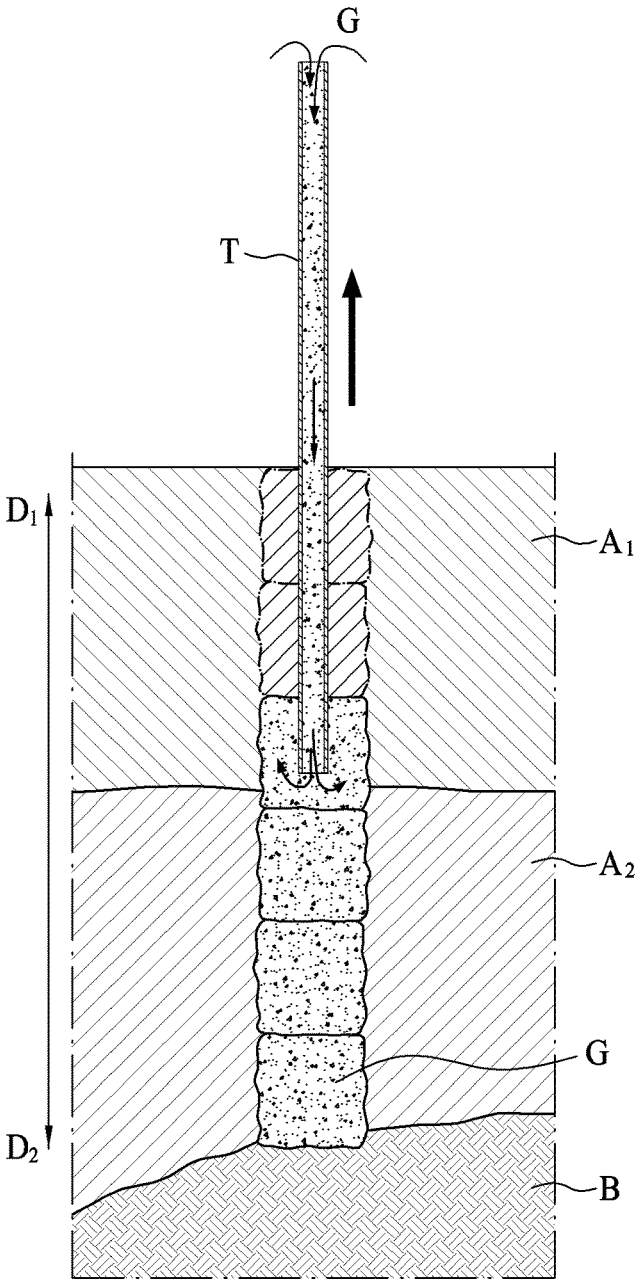
FIG. 3 is a diagram illustrating a state of forming a grout pillar in the ground with different upper and lower qualities of soil, using the C.G.S construction method.
Figure 4:
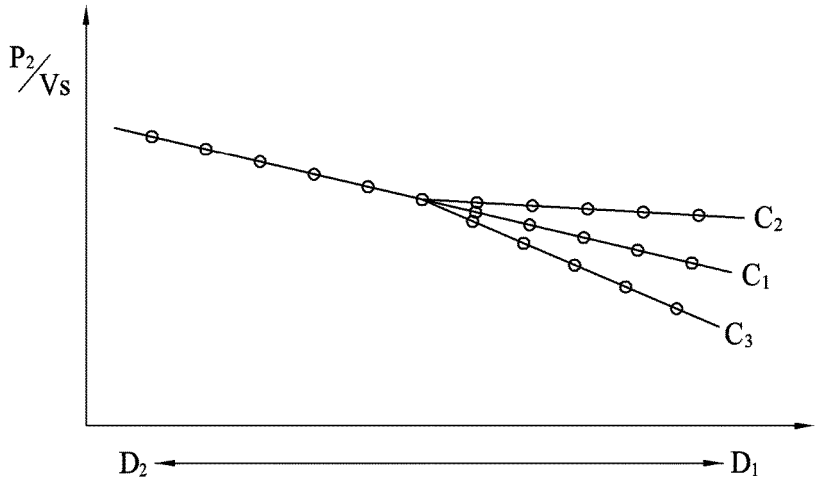
FIG. 4 is a graph illustrating the ratio of the grout discharge pressure per each depth and the injection amount per unit time of the grout expressed in the case of FIG. 3.

Further, FIG. 3 is a diagram illustrating a state of forming a grout pillar in the ground with different upper and lower qualities of soil, using the C.G.S construction method. FIG. 4 is a graph illustrating the ratio of the grout discharge pressure per each depth and the injection amount per unit time of the grout expressed in the case of FIG. 3.

As illustrated in FIG. 1, when forming the pillar in the interior of the ground using the C.G.S construction method, pillars formed by grouts G can be formed in the form of passing through a soft ground so as to be able to a rigid rock layer B and the ground to support a structure or the like.

In the general C.G.S construction method, the construction is performed through a method of injecting the grout G and moving the injection pipe T upward, after an injection pipe T for injecting the grout G to the interior of the ground is inserted to a deep depth D2 which reaches the rock layer B through the soft ground A. The C.G.S construction method capable of performing the seismic reinforcement and the quality control according to the present invention will also be described based on such a method.

First, when the grout G is injected to the interior of the ground, the predetermined quantity of grout G is injected at an injection pressure of a predetermined static pressure per unit time, when a fixed amount of injection is completed, the injection pipe T can be raised at a predetermined interval and can be injected again.

At this time, if the quality of soil of the soft ground A, to which the grout G is injected, is uniformly formed from the deep depth D2 to a low depth D1, the grout G pillar of the similar amount and form is formed for each depth to which the grout G is injected, and the grout G can serve as a pillar.

In such a case, in the course of performing the entire processes, the injection amount per unit time of injection of the grout G can be the same.

Furthermore, although the injection pressure for injecting the grout G is also the same, the discharge pressure of the grout G discharged through the injection pipe T can be lowered in proportion to a distance at which the injection depth of the grout G is moved from the deep depth D2 to the low depth D1.

Accordingly, as illustrated in FIG. 2, when a value obtained by dividing the discharge pressure V2 of the grout G for each injection depth expressed in the overall injection course by the injection amount Vs of the grout G per unit time is expressed by a graph, it is possible to know that the amount of change is constant.

However, because a case where all the internal soil conditions of the ground are uniform is very rare, as illustrated in FIG. 3, the internal soil conditions of the ground can be partially different from each other.

FIG. 3 simply illustrates a case where the internal soil conditions of the ground are different from each other at the top and the bottom, and the principles of the present invention will be described on the basis of such a case.

In FIG. 3, when the upper layer A1 of the soft ground A is constituted by the ground formed to be denser than the lower layer A2, the grout G can be injected in the order of the lower layer A2 to the upper layer A1 of ground in the process of raising the injection pipe T, while injecting the grout G through the C.G.S construction method.

At this time, as described above, the discharge pressure of the grout G injected into the ground is lowered in proportion to a change in the injection depth. When injected to the upper layer A1 section that is relatively densely formed, the discharge pressure of the grout G can be lowered to a relatively small level.

That is, when the internal soil conditions of the ground becomes relatively dense during the injection process of grout G, it is possible to measure the discharge pressure that is relatively higher than the discharge pressure of the grout G that can be expected when the internal soil conditions of the ground are uniform.

In such a case, because the density of the grout G itself becomes different for each injection depth in the pillar formed by injection of the grout G, it is not possible to appropriately support the force transmitted by the ground, and a phenomenon of the ground being crushed by the pressure of the grout G in the construction process may also occur.

Meanwhile, as opposed to the aforementioned assumption, when the lower layer A2 of the soft ground A is constituted by a ground that is formed to be denser than the upper layer A1, it is also possible to inject the grout G in the order of the lower layer A2 to the upper layer A1 in the process of raising the injection pipe T while injecting the grout G via the C.G.S construction method.

At this time, the discharge pressure which is lowered in proportion to the change in the injection depth of the grout G can be relatively greatly lowered, while injecting to the upper layer A1 section that is relatively loosely formed.

That is, when the internal soil conditions of the ground become relatively loose during the injection process of the grout G, it is possible to measure the discharge pressure that is relatively lower than the discharge pressure which can be expected when the internal soil conditions of the ground are uniform.

In such a case, it is not possible to form a stable pillar form such as an overall shape of the grout G pillar formed to be broadened to one side while injecting the grout G, and thus, it may not be possible to properly support the force that is transmitted from the ground.

As illustrated in FIG. 4, such a change can be seen through a graph illustrating the value obtained by dividing the discharge pressure V2 of the grout G for each injection depth generated in the course of the overall injection by the injection amount Vs of the grout G per unit time.

The graph expressed when the internal soil conditions of the ground are generally uniform can expect a form of C1. However, when the soil conditions of the upper layer A1 become relatively dense in the course of injecting the grout G from the deep depth D2 to the low depth D1, it is possible to express a shape of a graph of C2, and when the soil conditions of the upper layer A1 become relatively loose, a shape of a graph C3 can be expressed.

Accordingly, it is possible to form the grout G pillar of more uniform and constant form by preventing the deformation of the form of the graph.

Next, the process of an embodiment of the C.G.S construction method capable of performing the seismic reinforcement and quality control according to the present invention that can be performed in accordance with the aforementioned principles will be described in detail with reference to FIG. 5.

Figure 5:
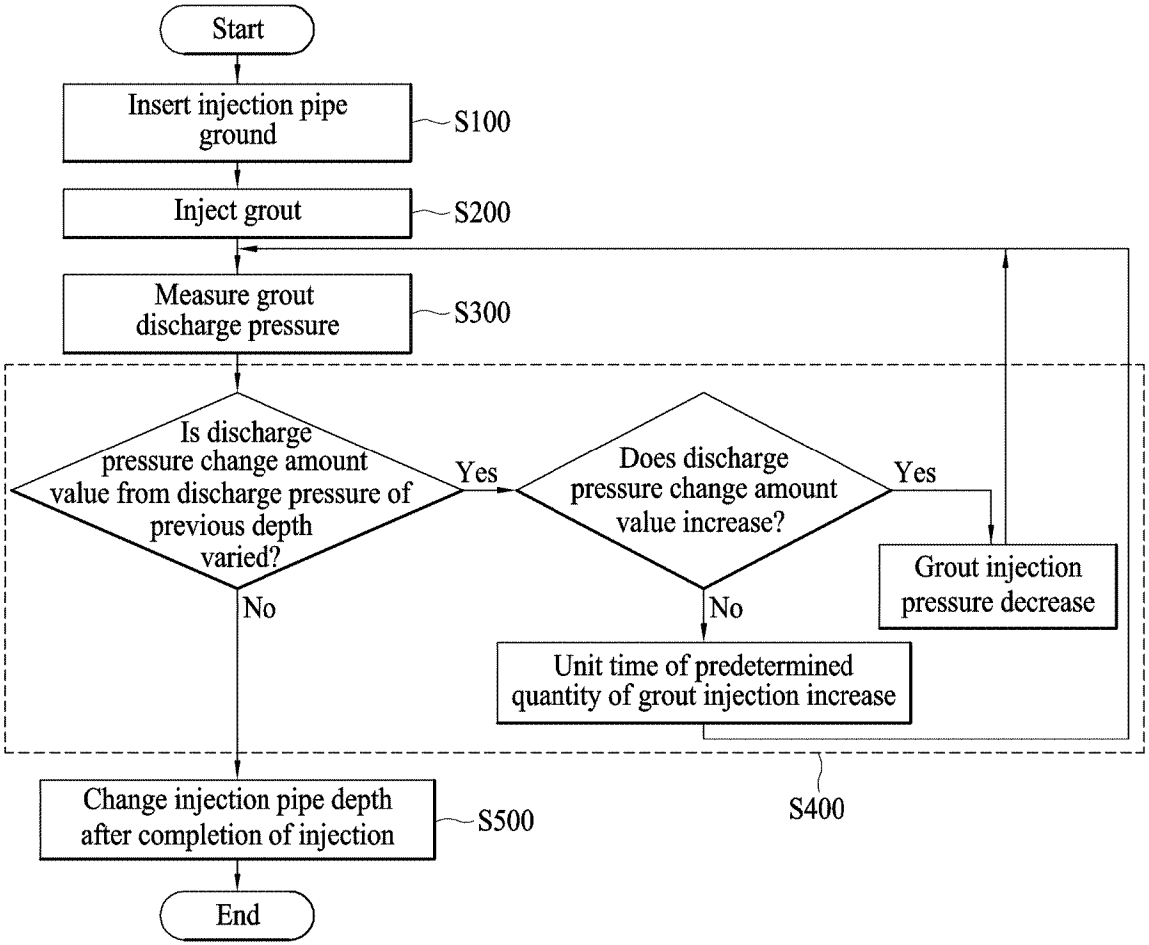
FIG. 5 is a flowchart illustrating an execution procedure of the C.G.S construction method capable of performing a seismic reinforcement and quality control according to the present invention.

Here, FIG. 5 is a flowchart illustrating the execution process of the C.G.S construction method capable of performing the seismic reinforcement and quality control according to the present invention.

First, as illustrated in FIG. 5, an embodiment of the C.G.S construction method capable of performing the seismic reinforcement and quality control according to the present invention may include an injection pipe inserting step (S100), an injecting step (S200), a pressure measuring step (S300), an injection adjusting step (S400) and a depth changing step (S500).

The injection pipe inserting step (S100) is a step of injecting the injection pipe T provided to inject the grout G into the interior of the ground. It is possible to insert the injection pipe T to a depth at which the grout G pillar formed using the C.G.S construction method capable of performing the seismic reinforcement and quality control according to the present invention can sufficiently support the force transmitted from the ground.

Further, the injection pipe inserting step (S100) may further include a perforation process for perforating the ground in advance to secure a space for inserting an injection pipe T.

Meanwhile, the injecting step (S200) is a step of injecting the grout G into the interior of the ground through the injection pipe T inserted in the injection pipe inserting step (S100) as described above. In this embodiment, the predetermined quantity of grout is injected at an injection pressure of a predetermined static pressure per unit time when injecting the grout G.

In general, when constructing the C.G.S construction method, the sample of the ground is taken in advance to measure ground permeability for each depth. It may be advantageous to set and determine the injection amount per unit time ting to be less than 50 times the ground permeability of the ground measured in advance when injecting the grout G in the injecting step (S200).

This is in order to prevent the ground itself from being fractured while the grout G being injected into the ground.

Meanwhile, the pressure measuring step (S300) is a step of measuring the discharge pressure of the grout G that is injected in the aforementioned injecting step (S200). It is possible to measure the pressure at a position where the grout G is injected into the interior of the ground, or it is possible to measure the pressure the grout G discharge unit at a rear end of the pump that supplies the grout G.

Next, the injection adjusting step (S400) is a step of adjusting at least one or more of the injection pressure of the grout G of the injecting step (S200) and the unit time at which the predetermined quantity of grout G is injected, depending on the value of the variation amount of the discharge pressure measurement measured in the aforementioned pressure measuring step (S300).

The detailed matters of adjustment of the injection of the grout G in the injection adjusting step (S400) will be described later.

Meanwhile, the depth changing step (S500) is a step of changing the step at which the injection pipe T is inserted into the ground after injection of the grout G is completed.

After performing the depth changing step (S500), the grout G is repeatedly injected for each depth again from the injecting step (S200), and the grout G pillar can be formed in the interior of the ground.

Further, in the injecting step (S200) repeated again at this time, it may be advantageous to inject the grout G, while keeping the injection setting of the grout G in which the setting for injecting the grout G is changed in the injection adjusting step (S400) before the aforementioned depth changing step S500.

The reason is that, when the previous soil conditions of the injection depth of the grout G are changed, there is a high possibility that the subsequent soil conditions of the injection depth of the grout G are also the same.

A more detailed method of the injection adjusting step (S400) for checking and managing whether the overall grout G pillars are appropriately formed on the basis of the discharge pressure of the grout G to be measured for each depth in the above-described process will be described as follows.

As described above, the discharge pressure of the grout G measured in the pressure measuring step (S300) may vary in proportion to the depth of injection depth of the grout G.

However, when the value of the amount of change in the discharge pressure of the grout G measured by the pressure measuring step (S300) varies, it is possible to determine that the soil conditions of the ground into which the grout G is injected is not uniform for each depth.

Accordingly, it is possible to check whether the amount of change of the discharge pressure of the grout G obtained in the course of repeatedly performing the steps of the C.G.S construction method capable of performing the seismic reinforcement and quality control according to the present invention varies.

First, when there is no variation in the value of the discharge pressure variation amount of the grout G, the injection of grout G is completed, while maintaining the setting for injecting the grout G, and it is possible to change the depth at which injection pipe T is inserted into the interior of the ground.

However, when the value of variation amount of the grout G of the discharge pressure varies, it is possible to change the injection setting of the grout G.

First, when the value of the variation amount of the discharge pressure of the grout G increases, it may mean that the soil conditions of the depth in which the grout G ground is currently injected are denser than the previous soil conditions of the injecting the grout G.

In such a case, because the grout G is forcibly injected and the ground may be fractured, it is possible to uses a method of lowering the discharge pressure of the grout G by lowering the injection pressure at which the grout G is injected into the ground.

Meanwhile, when the value of the variation amount of the discharge pressure the grout G becomes smaller, it may mean that the soil conditions of the depth of currently injecting the grout G is looser than the soil conditions of the depth of previously injecting the grout G.

In such a case, while injecting the grout G in the original setting, because the overall shape of the pillar of the grout G may be disturbed, while the grout G being spread, it is possible to use a method for adjusting the injection rate by increasing the unit time at which the predetermined quantity of gout G is injected.

That is, by providing the relatively long time at which the grout G can be lightened through the adjustment of such injection setting of the grout G to form the pillar of the grout G of more uniform shape, it is possible to construct the foundation that effectively supports the force that is applied to the ground.

For example, it is also possible to form the regular grout G pillar in the sections in which a void is formed inside the ground or water flows.

Meanwhile, by performing the process of adjusting the injection settings of the grout G as described above, and measuring the value of variation amount of the discharge pressure of the grout G, it is possible to check whether the value changes and perform the next process.

When the injection of grout G is completed over the entire depth, while repeating the above-mentioned processes, the construction of the C.G.S construction method capable of performing the seismic reinforcement and quality control according to the present invention can be completed.

It is possible to check the internal conditions of the ground into which the grout G is injected in real time though such a process, and it is possible to optimize the injection conditions of the grout G correspondingly.

Therefore, it is possible to form the pillar of uniform grout G regardless of the irregular changes of the ground layer and soil conditions that are difficult to be checked with the naked eyes, and it is possible to obtain effects such as the construction quality control and the ground crushing phenomenon by quickly addressing the problems that can occur during the construction.

That is, it is possible to obtain an effect that can continuously manage the injection conditions of the grout G in accordance with the conditions of the ground when performing the entire processes described above.

Further, although specific embodiments of the present invention have been described and illustrated as described above, it will be obvious to those skilled in the art that the present invention is not limited to the described embodiments and can be variously modified changed without departing from the spirit and scope of the present invention. Accordingly, such modifications and variations should not be understood individually from the spirit and aspect of the present invention, and the modified examples fall within the scope of the following claims.

The invention claimed is:

1. A compaction grouting system ("C.G.S") construction method capable of performing a seismic retrofit and a quality control, the method comprising:

an injection pipe inserting step for inserting an injection pipe, which is provided to inject a grout into a ground, to an insertion depth;

an injecting step injecting the grout into the ground with a constant quantity at an injection pressure of a predetermined constant pressure per unit time and controlling at least one of the unit time at which the grout is injected with a constant quantity and the injection pressure of the grout;

a pressure measuring step measuring adjacent to a grout discharge port of an injection pump unit a discharge pressure at which the grout injected in the injecting step is being discharged for each injection depth of the grout;

an injection adjusting step calculating a measurement value obtained by dividing the discharge pressure of the grout measured in the pressure measuring step by the injection quantity of the grout per unit time for each injection depth of the grout and adjusting, depending on a change in the measurement value for each injection depth of the grout, at least one or more of the injection pressure of the grout in the injecting step, and the unit time at which predetermined quantities of the grout are injected; and a depth changing step changing the insertion depth at which the injection pipe is inserted in the ground after the injection of the grout is completed, wherein the injection adjusting step adjusts the grout injection pressure of the injecting step to be lower than the predetermined static pressure, when the change in the measurement value of the discharge pressure for the insertion depth measured in the pressure measuring step increases, and wherein the injection adjusting step increases the unit time at which the predetermined quantity of grout of the injecting step is injected, when the change in the measurement value of the discharge pressure for the insertion depth measured in the pressure measuring step decreases.

2. The method of claim 1, wherein the injecting step injects the grout by settings that are adjusted in the injection adjusting step, when performing the injecting step again after the depth changing step.

3. The method of claim 1, wherein the injecting step is set so that an injection amount per unit time set when injecting the grout is equal to or less than 50 times a ground permeability of the ground to which the grout is injected.

* * * * *